US006191705B1

(12) United States Patent
Oomen et al.

(10) Patent No.: US 6,191,705 B1
(45) Date of Patent: Feb. 20, 2001

(54) RADIO FREQUENCY HIGHWAY MANAGEMENT SYSTEM

(75) Inventors: Peter Oomen, Georgetown; James Kenneth Cook; Daniel L. Terrier, both of Toronto, all of (CA)

(73) Assignee: Mark IV Industries, Limited, Mississauga (CA)

( * ) Notice: Under 35 U.S.C. 154(b), the term of this patent shall be extended for 0 days.

(21) Appl. No.: 09/527,307

(22) Filed: Mar. 16, 2000

(30) Foreign Application Priority Data

Mar. 17, 1999 (CA) ..... 2265398

(51) Int. Cl.[7] ..... G08G 1/09

(52) U.S. Cl. ..... 340/905; 340/928; 235/384; 701/117

(58) Field of Search ..... 340/905, 928; 235/384; 701/117; 364/405

(56) References Cited

U.S. PATENT DOCUMENTS

| | | | | |
|---|---|---|---|---|
| 4,104,630 | | 8/1978 | Chasek | 343/6.5 R |
| 4,303,904 | * | 12/1981 | Chasek | 235/384 |
| 4,870,419 | | 9/1989 | Baldwin et al. | 372/46 |
| 4,937,581 | | 6/1990 | Baldwin et al. | 342/44 |
| 5,132,687 | | 7/1992 | Baldwin et al. | 342/44 |
| 5,164,732 | | 11/1992 | Brockelsby et al. | 342/44 |
| 5,192,954 | | 3/1993 | Brockelsby et al. | 342/42 |
| 5,196,846 | | 3/1993 | Brockelsby et al. | 340/933 |
| 5,253,162 | * | 10/1993 | Hassett et al. | 364/405 |
| 5,289,183 | | 2/1994 | Hassett et al. | 340/905 |
| 5,422,473 | * | 6/1995 | Kamata | 235/384 |
| 5,751,973 | * | 5/1998 | Hassett | 395/213 |
| 5,805,082 | * | 9/1998 | Hassett | 340/928 |

* cited by examiner

*Primary Examiner*—Daniel J. Wu
*Assistant Examiner*—Phung Nguyen
(74) *Attorney, Agent, or Firm*—Young & Basile, P.C.

(57) ABSTRACT

Traffic management or enforcement is performed through the use of a monitor transponder in the environs of an RF highway toll collection system. When normally operating transponders communicate with a roadside reader system, the roadside system communicates with the monitor transponder, which in turn signals if a valid normal transponder is detected. If no signal is generated by the monitor transponder, it is evident that the vehicle has no transponder or that the transponder is faulty or invalid.

10 Claims, 1 Drawing Sheet

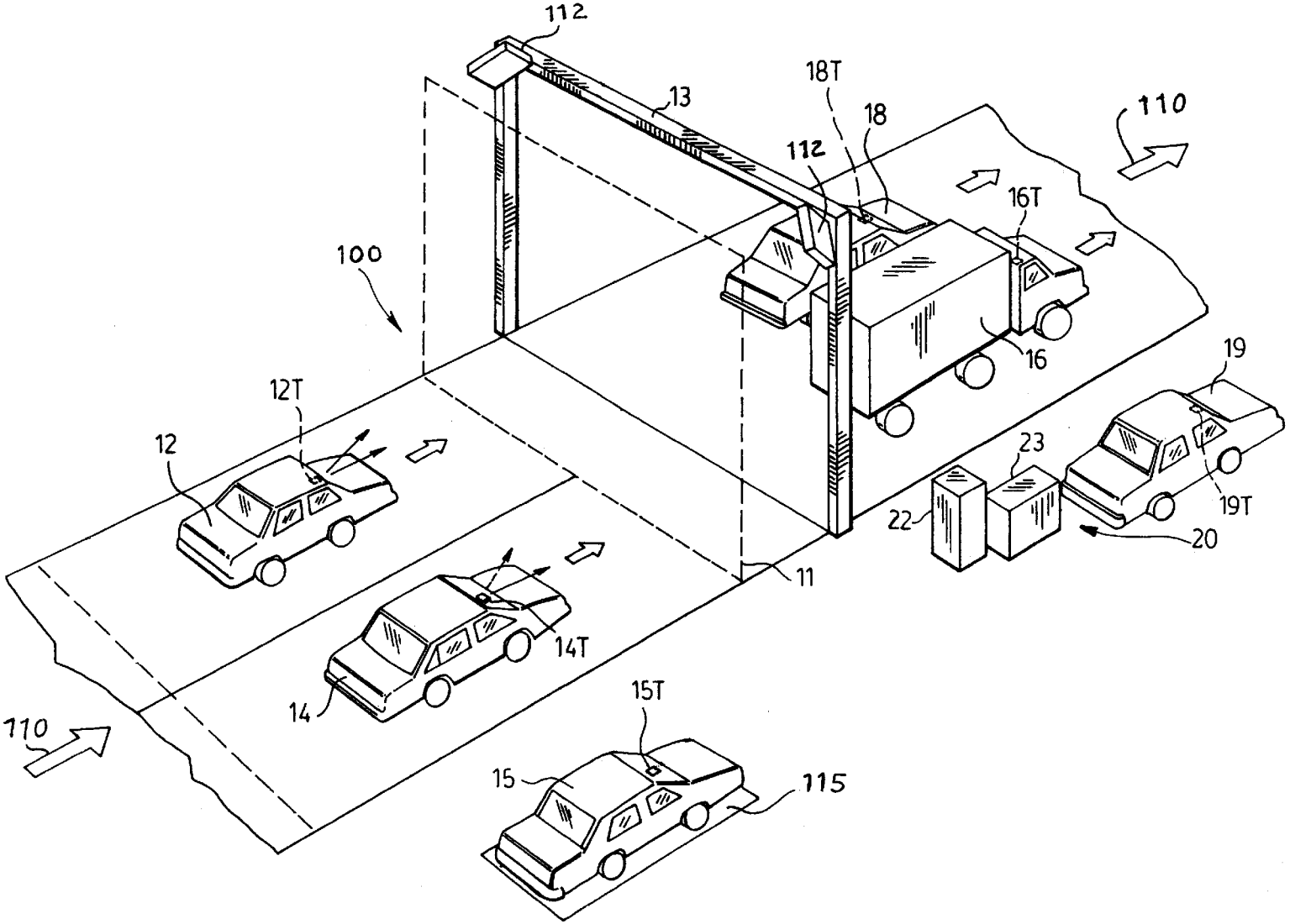
110
19
19T
20
16T
16
23
22
18
18T
112
11
115
13
15T
112
14T
15
100
12T
14
12
110

RADIO FREQUENCY HIGHWAY MANAGEMENT SYSTEM

FIELD OF THE INVENTION

This invention relates to traffic management and monitoring.

BACKGROUND OF THE ART

This invention has its principal application in the environs of an extent of highway planned for radio frequency (RF) toll collection where a substantial number of motor vehicles are equipped with transponders for communication with a roadside RF system for the assessment of tolls. Such transponders are called "normal transponders" herein to distinguish from what are called monitor transponders herein which assist in traffic management and monitoring.

The principles of automatic RF highway toll collection are discussed in the following patents:

U.S. Pat. No. 4,104,630 August 1978 Chasek

U.S. Pat. No. 4,303,904 Dec. 1, 1981 Chasek

U.S. Pat. No. 4,870,419 Sep. 26, 1989 Baldwin et al

U.S. Pat. No. 4,937,581 Jun. 26, 1990 Baldwin et al

U.S. Pat. No. 5,132,687 Jul. 21, 1992 Baldwin et al

U.S. Pat. No. 5,164,732 Nov. 17, 1992 Brockelsby et al

U.S. Pat. No. 5,192,954 Mar. 9, 1993 Brockelsby et al

U.S. Pat. No. 5,196,846 Mar. 23, 1993 Brockelsby et al

U.S. Pat. No. 5,289,183 Feb. 22, 1994 Hassett et al

The transponder which communicates with a roadside RF system customarily carries memory having such data characteristics as: transponder ID, vehicle class, revenue types, ownership, status of account, place of entry to or exit from a toll highway. The list of data characteristics may vary with different toll environments. However many of the above characteristics and others not mentioned may be desired by the local (as distinct from the overall) traffic authority for traffic monitoring or management or enforcement.

In some jurisdictions, a working transponder may be required by law for commercial vehicles, and optional, or not at all, for vehicles of other classes. In the latter case the enforcement procedures will only be employed for commercial vehicles.

Other requirements may be chosen by particular jurisdictions.

On a toll highway, a ramp, entrance or exit will have a highway extent often called a communications zone where the transponder may be written to or read from, by a reader which is located near the communications zones usually by the roadside or on an overhead gantry. Thus the communications zones must be within the transmission range of the reader and transponder.

The reader is that part of a roadside RF system which normally writes to or reads from a transponder in the communications zone.

In normal toll operations, a transmitter associated with the reader, located near the communications zone emits a periodic RF signal intended to activate the circuitry of any transponder in the communications zone. Transponders so activated in the communications zone call the reader at random. However both the reader and transponder are subject to a protocol which ensures that the reader communicates with only one such transponder at a time.

The normal transponder stores data which will typically include: public and private identification of the owner, last previous point of entry or exit, class of vehicle, status of account, etc.

When interrogated by the reader, the normal transponder will typically be programmed to release all or some of such information to the reader.

Upon the issuance of a "write" command to a normal transponder by RF signal from the reader, the data in the normal transponder may be changed, with the exception of identification information, which is only altered at special stations.

The reader may communicate at roadside with a passing transponder to extract information from the transponder as to last recorded location and add to it or replace it with the present location.

The "last recorded address" will usually be the address of entrance of the transponder-carrying vehicle into the highway system while the present address will normally be the address of leaving. Such addresses are of course used for toll calculation.

SUMMARY OF THE INVENTION

A transponder is used in accord with the present invention for traffic management or monitoring of traffic or for some enforcement purposes, such as the enforcement of the requirement that a commercial vehicle carry a transponder. The transponder used for one of the purposes outlined herein is spoken of herein as a monitor transponder to distinguish from transponders carried by the toll paying users. The latter transponders are referred to as normal transponders.

"The roadside RF system" is the term here used for the overall coordinated software for communication contemporaneously with a number of vehicle-borne transponders. The roadside RF system includes the reader which communicates directly with a normal transponder during a toll transaction.

A monitor transponder may be physically identical to a normal transponder. However, although such physical identity makes it usable for normal toll transactions, its usual extended stay within RF range of the communications zone, is used by the roadside RF system to determine (after consultation of the list of monitor transponder identifications) that it is a monitor transponder. The roadside RF system noting the extended stay of the monitor transponder in the communications zone then places the monitor transponder in "monitor" mode and purges it from the "present" list so that it is no longer polled by the reader. The roadside RF system filters the data received by the reader to pick out those transponders with the desired criteria. For example if the criterion is whether or not the transponder is a commercial vehicle, then the polling of such a commercial vehicle will actuate the roadside RF system to send a signal to a monitor transponder to cause it to make a sensible signal.

By "sensible signal" is meant a visible or audible signal. The sensible signal alerts the driver of the traffic authority or enforcement car (or the other custodian of the monitor transponder,) to check the commercial vehicle, the timing of the signal created by the radio RF system being chosen so that the subject vehicle is near a selected position (usually at the point of exit from the communications zone).

Thus in the case of the enforcement of the law that a commercial vehicle must carry a transponder, if the official at the monitor transponder sees a commercial vehicle, and the sensible indicator on the monitor transponder indicates that the criteria have been met, then the subject commercial vehicle is allowed to go on uninterrupted. If there is no sensible indication from the monitor transponder when a commercial vehicle is in the selected position, then enforcement procedures may be brought into place. In the usual course an official vehicle (usually other than the one with the monitor transponder) will pursue and pull over the commercial vehicle to determine whether it has a defective transponder or none at all.

If, at the time of the sensible indication in the monitor transponder, there are two commercial vehicles in the communications zone, the results are ambiguous, in which case it may be necessary to wait until the vehicles arrive at another monitored communications zone in the highway toll system.

The criteria could be changed, e.g. limited to commercial vehicles with accounts in good standing or with sufficient credit balance and a sufficiently charged transponder battery. In such cases, the sensible indication will not be given if any of these criteria is not met.

Criteria may be used which do not include the commercial vehicle. However unless there is a visual difference in the vehicles to be checked, it will not be possible to associate the sensible signal with a specific vehicle. However the sensible signal serves to provide an indication that a vehicle having a particular characteristic has passed the monitoring point. The sensible indication (usually beep or light) from a monitor transponder, may also usefully provide a count of vehicles registered as non revenue class, number of vehicles entering at a specific toll location, vehicles registered with a specific toll agency, etc.

The roadside RF system is responsive to the detection in the communications zone of a transponder with the characteristics it is desired to detect. In this event, the roadside RF system is designed to treat the monitor transponder as a signalling device of the passage of the vehicle with the selected characteristics and cause it to emit a sensible signal, preferably audible. The sensible signal initiated by the roadside RF system is caused at the monitor transponder and the timing is selected to correspond to the subject vehicle's passage through a relatively small area (e.g. under the gantry) where in many cases it can be identified. In one communication protocol, a signal called a Default-Write signal from the reader to the vehicle transponder, (the "Default-Write" signal corresponding to the end of a toll transaction with the subject transponder,) sets the time for the signal from the roadside RF system to the enforcement transponder.

As a result the person in the official vehicle will receive a signal each time a vehicle passes whose transponder indicates that it has the desired characteristics. Thus in the case of a commercial vehicle, where that is the subject characteristic, when the commercial vehicle passes out of the communication zone, and such signal is absent, the operator of the vehicle with the monitor transponder may cause inspection of the subject commercial vehicle.

Instead of a single characteristic, it may be desired to detect logical combinations of characteristics. Thus a commercial vehicle with a proper transponder may have an inadequate account status as indicated in the roadside RF system or contained in the transponder data. A "filter" can thus be programmed which combines several characteristics and will not cause the monitor transponder to issue a sensible signal for vehicles which do not have the combined characteristics, and in the case of a commercial vehicle causing an enforcement action to be initiated.

If inspection is undertaken this is usually by a portable reader in a vehicle other than the one with the monitor transponder which failed to receive the sensible indication. This portable reader is to be held close to the normal transponder if one is found in the subject vehicle. The signals received will thus contain the data from the vehicle transponder. The signals received will thus indicate such items as identification number, revenue status, vehicle class, entry data, entry time, etc. A printer may be attached to the portable reader to make a permanent record of the data transferred from the subject vehicle normal transponder.

The portable reader may be held within inches of the transponder and so that the strongest radiation axes of their respective antennas align. The attenuation of the reader to a received signal may be increased until it cannot be received more than a meter or less away. Thus the operation may be carried on so that the subject transponder may be read without interfering with any other nearby transponders.

BRIEF DESCRIPTION OF THE DRAWINGS

In drawings which illustrate a preferred embodiment of the invention:

FIG. 1 shows schematic illustration of the operation of the system.

DESCRIPTION OF THE PREFERRED EMBODIMENTS

In the drawing, there is shown an extent of toll highway which represents a communications zone 100 having a downstream direction indicated by arrows 110. At a point which will correspond to an entrance or exit point from the highway, the tolling equipment is provided comprising a photography gantry 11 and, just downstream therefrom, the RF toll gantry 13 with antennas 112 thereon.

Motor vehicles 12 and 14 are shown approaching the gantry and motor vehicles 16 and 18 are shown having just passed the gantry, but the gantry could be downstream of vehicles 16, 18. It will be noted that motor vehicle 16 is a commercial vehicle.

The roadside RF system 20 comprises a processor 23 which includes the means for coordinating the reader, Application Processing, (not shown) Angle of Arrival Processor, (not shown) their interfaces and data link, including a reader 22 for communication, by means of the gantry antennas 112, with motor vehicle-borne normal transponders. Such vehicle-borne normal transponders are shown as 12T, 14T, 16T and 18T, of which 15T is a monitor or enforcement transponder located in an authority vehicle 15.

The protocol for communication between said transponders is a two-way RF communications system between transponders such as transponders 12T, 14T, 16T and 18T located on vehicles travelling on the toll highway and reader 22 forming part of an electronic toll collection system. The radio frequency (RF) signals used are usually about 915 Hz, and preferably signal at a data bit rate of 500 kbps. The roadside RF system is part of the electronic toll collection system. It includes the reader 22 located at the side of the highway, usually just down-stream from the RF gantry.

The reader continually outputs a signal which will activate a normal transponder circuit within the communications zone 100. Each normal transponder will answer at random. The reader and communications protocol will ensure that each communication with a transponder is in a different time slot.

The reader 22 continually polls for normal transponders which have not previously communicated or have just entered the zone.

The communication protocol will customarily cause the normal transponder to communicate specific data carried in memory. The data includes characteristics, such as the transponder identification code, class type, (e.g. standard, commercial, recreational), last entry/exit point and in some applications account status or balance and battery condition to the reader.

When the reader has polled a certain transponder, such as transponder 15T, and finds than it has been present too long in the communications zone it will check its identification. If the certain transponder is found to have a specific identification code, it is a monitor transponder, and the reader causes the roadside RF system 20 to place it in monitor mode. Preferably the roadside RF system causes the monitor transponder to emit a sensible (preferably visual) signal, so that the operator of the vehicle with the monitor transponder knows he is monitor mode.

The transponder circuit is so designed that when a normal transponder equipped vehicle comes within effective range of the gantry (the normal transponder RF range defines the limit of the communications zone 100) it operates under the protocol provided to provide data from its memory to the reader 22. The data will include its identification and any other matters specified in the protocol. These will normally include the vehicle class and battery condition and account status.

The end of the RF interchange between the normal transponder and the reader is usually signalled by a write message from the reader to the memory of the subject transponder. This is usually the signal known as "Default Wire". At the time that this signal is sent the vehicle will usually just be passing under the RF gantry 13.

The vehicle class information is among the data passed from the normal transponder to the reader. Where the enforcement procedures are restricted to vehicles of commercial class then this commercial class information is used by software associated with the radio RF reader to filter out the signals from normal non-commercial vehicle transponders and responsive to a signal from a commercial vehicle to control the reader to cause signals to be sent to those monitor transponders which are then in monitor mode. Thus the corresponding information from vehicles of non-commercial classes is filtered out. Further the protocol could, for example, be altered so that the information from commercial vehicles with low or negative account balances or status is also filtered out.

The radio RF reader software is designed to limit the number of monitor transponders in monitor mode at one time. Three is the preferred number.

The enforcement or monitor transponder preferably has identical construction to the normal transponders. It has however a specific radio identification by which the radio RF system distinguishes between normal and enforcement or monitor transponders. When a "Default-Write" signal is written to a subject normal transponder, the fact that it is written to a monitor transponder causes a signal from the reader to the monitor transponder to cause a sensible signal therein. This informs the official in the monitor vehicle 15 that the passing commercial vehicle is equipped with a working transponder which has met the other criteria set for it.

Thus special monitor software in processor 23 is required to filter incoming normal transponder data, and when it corresponds to information from a commercial vehicle normal transponder, to signal any monitor transponder which is present near the communications zone to issue a sensible signal with the passage of each commercial vehicle. In the example chosen, where commercial vehicles are the subject of monitoring proceedings, the filter is present to pass on only signals corresponding to commercial vehicle normal transponders operating properly with accounts in good standing.

The signal then sent to the monitor transponder 15T will cause it to emit a sensible signal preferably in the form of a beep.

The vehicle 15 carrying the monitor transponder, (the enforcement vehicle), will typically be located at the side of the road, within the edge of the communications zone.

When the vehicle with the monitor transponder enters the communications zone 100, it will (if it is a fully equipped transponder) be treated like a normal transponder, and exchange information with reader 22. However the failure of the vehicle to pass out of the range of the reader will cause reader 22 to cease trying to interchange the information with the monitor transponder and the reader will cause the system to place the monitor transponder in monitor mode (and cause the reader to ignore the monitor transponder in monitor mode for ordinary toll transactions).

The monitor mode is preferably indicated to the monitor transponder by illuminating a green LED periodically on the monitor transponder.

There is also a portable reader (not shown) for carrying in a monitor vehicle.

The monitor portable reader is designed for communication with a normal transponder and is used to check on the condition (or presence) of the transponder in a suspect vehicle. The transmission range of the monitor portable reader is preferably attenuated to make a transmission range of about a meter. Thus transmissions from the enforcement portable reader may cause communication when held close and preferably with the antenna's main axes aligned but will not randomly interfere with other RF equipment at a grater distance.

Noting FIG. 1, the monitor vehicle 15 parked by the roadside at the edge of the communications zone 100 is in the best location for a monitor transponder 15T in monitor mode. Thus the reader and applications will have determined the existence of an enforcement or monitor transponder 15T in the communications zone 100. From its failure to pass out of the communications zone the reader and applications will have placed it in monitor mode. (This will be done for up to a maximum number of monitor transponders—three is preferred). Thus at least one of these monitor mode transponders should be in location 115 near or in the communications zone and will be actuated by the "echo" signal from the reader (triggered by the Default-Write command to the normal transponder,) and the fact that the normal transponder is of the subject class. The "echo" RF signal actuates monitor transponder 15T in monitor mode to emit a beep when there has been a passing transponder from a vehicle associated with the characteristics being monitored which has completed a successful communication with the reader. Thus when the reader 22 determines (from the data received), that the subject vehicle is commercial, the filtered reaction is to send a beep echo signal to the monitor vehicle. If such a vehicle is present near the exit from the communications zone then the monitor official is alert to this fact.

If a "beep" is heard on the monitor transponder 15T in monitor mode, then the official monitor vehicle 15 knows that the subject vehicle's normal transponder is working (and any other characteristics involved in releasing the beep signal, (such as a valid account and sufficient battery charge). However if a beep is not heard at the monitor transponder 15T, then the official realizes that the subject commercial vehicle either has no transponder or it fails one of the criteria set out above.

It is then necessary to make a physical inspection of the subject commercial vehicle 16 which has been identified as having no or a faulty transponder. Most commonly this will involve a second official monitor vehicle e.g. vehicle 19. Continuing inspection of transponders in the communications zone will require a monitor transponder 15T remaining in position. On the other hand, the portable reader (not shown) must be continually available for monitoring. Thus although there are many possible scenarios, the most common has an official vehicle 15 continuously near the exit from the communications zone carrying a monitor transponder and available to be placed in monitor mode for negative selection; and an official vehicle 19 near to the exit from communications zone, ready to follow and flag down a vehicle (a commercial vehicle in the example given) to inspect for the absence of a transponder or a problem therein. The monitor transponder vehicle 19 carries the portable monitor reader to test any transponder found in the vehicle flagged down.

It is convenient to provide the portable reader with a printer (not shown) which may be programmed to print out the information or selected information received from the subject transponder. This may include vehicle class, battery, strength, account status or balance. If the subject normal transponder had a scratch pad memory, then the subject normal transponder may be equipped to send to the portable reader the record of its ramp entry and exit points. Thus the official operating the portable reader may be able to hand to a driver of the inspected vehicle the record of the faulty normal transponder showing location date and fault with the normal transponder.

As will be apparent to those skilled in the art in the light of the foregoing disclosure, many alterations and modifications are possible in the practice of this invention without departing from the spirit or scope thereof. The foregoing description is of the preferred embodiments by way of example only, and is not to limit the scope of the invention.

What is claimed is:

1. In a highway toll collection system where normal transponders carrying specific vehicle identification information are carried on motor vehicles and communicate with a roadside radio frequency (RF) system, said normal transponders being actuatable by a signal from the roadside RF system to record the address of the roadside system at the transponder and transmit the transponder identification information, including a selected class of vehicle, to the roadside RF system, the improvement comprising: a monitor transponder located to receive a detection signal from the roadside RF system;

said roadside RF system including receiving means responsive to the transmission of said specific vehicle information from the normal transponder and including means for sending said detection signal to said monitor transponder thereupon; and said monitor transponder including means responsive to said detection signal to emit a sensible signal upon receipt of said detection signal.

2. A highway toll collection system as claimed in claim 1 wherein said roadside RF system receiving means is responsive to the transponder identification information including the fact that the vehicle is a commercial vehicle.

3. A highway toll collection system as claimed in claim 1 wherein said sensible signal is audible.

4. In a highway toll system wherein toll information is exchanged between transponders in vehicles and a roadside radio frequency (RF) system the improvement comprising: the transponders including means for providing a sensible indication responsive to an RF detection signal from the roadside RF system; preselected ones of said transponders being designated monitor transponders having a specific identification code; and the roadside RF system including means for determining if preselected toll information is received from the transponders and if so, transmitting a detection signal to the transponders having said specific identification code.

5. A highway toll system as claimed in claim 4 wherein the monitor transponders include monitor mode indicating means responsive to an activation signal received from the roadside RF system.

6. A highway toll system as claimed in claim 5 wherein the toll information exchange occurs in a communications zone, wherein said monitor transponders are also adapted to act as a normal transponders and wherein the roadside RF system includes means for transmitting a monitor activation signal to the monitor transponders if the monitor transponders fail to clear the communications zone within a predetermined time from entering said communications zone.

7. A highway toll collection system as claimed in claim 4 wherein the toll information includes a vehicle class record, the roadside RF system being responsive to the receipt of a transponder signal including a specific type of class record to send said detection signals on receipt of said signals, thus causing the monitor transponders to emit a sensible signal.

8. Apparatus for monitoring normal transponder bearing vehicles in a highway toll collection system where said normal transponders carry transmissible data in memory defining one or more characteristics, the apparatus comprising: a roadside RF system which receives transmissible data from said normal transponders;

a monitor transponder for location within the communication range of said roadside RF system capable of providing a sensible signal in response to a detection signal from said roadside RF system; and means associated with said roadside RF system, conditional on detection of at least one selected characteristic from data transmitted by a said normal transponder, for transmitting a detection signal to said monitor transponder causing provision of a sensible signal.

9. Apparatus as claimed in claim 8 wherein said monitor transponder also carries transmissible data in memory defining one or more characteristic, and wherein the means conditional on detection is also conditional on detection of at least one selected characteristic from the data transmitted by the monitor transponder.

10. A method of monitoring normal transponders in transponder bearing vehicles in a communications zone of a highway toll collection system, comprising the steps of:

causing the system to emit a detection signal if a transmission from a vehicle transponder includes a specific data characteristic; providing a monitor transponder which emits a sensible signal upon receipt of said detection signal; and identifying vehicles passing through the communications zone with no sensible signal being emitted from the monitor transponder.

* * * * *